US006701625B1

(12) United States Patent
Thomason et al.

(10) Patent No.: US 6,701,625 B1
(45) Date of Patent: Mar. 9, 2004

(54) SPOON WITH FLEXIBLE SIDES

(75) Inventors: Scott R. Thomason, Maple Heights, OH (US); Tamara Thomason, Maple Heights, OH (US); Nicholas J. Mastandrea, Newbury, OH (US)

(73) Assignee: Great Lakes Engineering + Design, Solon, OH (US)

( * ) Notice: Subject to any disclaimer, the term of this patent is extended or adjusted under 35 U.S.C. 154(b) by 0 days.

(21) Appl. No.: 10/256,939

(22) Filed: Sep. 26, 2002

(51) Int. Cl.[7] ..... A47J 43/28
(52) U.S. Cl. ..... 30/324; D7/653
(58) Field of Search ..... 30/324, 326, 328, 30/141, 147, 149, 150; D7/653

(56) References Cited

U.S. PATENT DOCUMENTS 4,956,917 A * 9/1990 Chung ..... 30/326
D412,813 S * 8/1999 Roskind et al. ..... 30/324
6,145,204 A * 11/2000 Cash ..... 30/322

* cited by examiner

*Primary Examiner*—Douglas D. Watts
(74) *Attorney, Agent, or Firm*—Brouse McDowell; Roger D. Emerson

(57) ABSTRACT

A spoon includes a handle and trough for containing food. The trough includes a flexible wall extended from a peripheral edge for assisting in containing the food when the spoon is tilted from the horizontal. The flexible wall collapses when the spoon is placed in the mouth.

4 Claims, 2 Drawing Sheets

SPOON WITH FLEXIBLE SIDES

I. BACKGROUND OF THE INVENTION

A. Field of Invention

This invention pertains to spoons and more particular to spoons having a raised flange or assisting in containing food.

B. Description of the Related Art

Spoons are well known in the art to contain food products for placement into a mouth during the eating process. One application especially suitable for spoons is to maneuver fluids or liquids into the mouth of a person. In elderly people, small children, physically challenged people, or the like it may be difficult to place the fluids or liquids into their mouth without spilling the fluid or liquid.

Since small children, elders, and physically impaired adults often have difficulty maintaining the spoon in a horizontal position, resulting in food or liquid falling off the spoon, the present invention provides a unique spoon design that prevents food from falling off the spoon when the spoon is rotated substantially away from the horizontal position.

II. SUMMARY OF THE INVENTION

The invention describes a spoon that includes a raised flange around the circumference of the spoon, said flange acting to retain food or liquid in the spoon even when the spoon is rotated substantially away from the horizontal axis. The flange is flexible so that when a person closes their mouth over the spoon the flange collapses and the food contained therein is released into the person's mouth.

Still other benefits and advantages of the invention will become apparent to those skilled in the art to which it pertains upon a reading and understanding of the following detailed specification.

III. BRIEF DESCRIPTION OF THE DRAWINGS

Figure 1A:
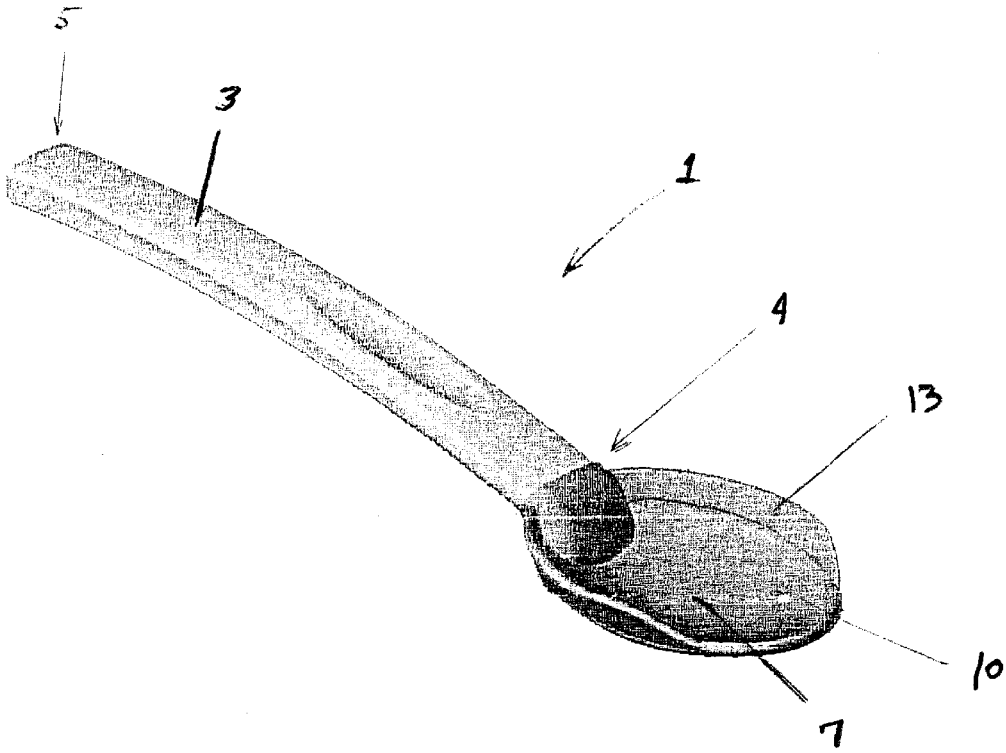

The invention may take physical form in certain parts and arrangement of parts, a preferred embodiment of which will be described in detail in this specification and illustrated in the accompanying drawings which form a part hereof and wherein:

FIG. 1*a* shows a perspective view of the spoon.

Figure 1B:
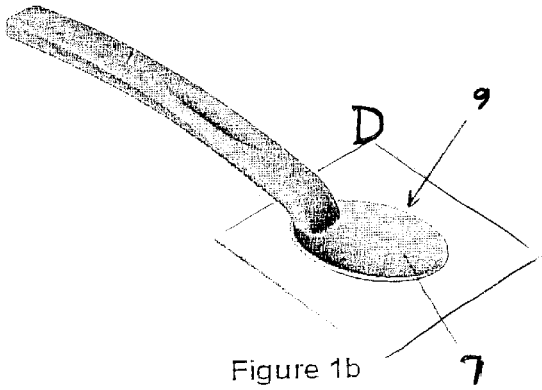

FIG. 1*b* shows a perspective view of a spoon without a raised flange.

Figure 1C:
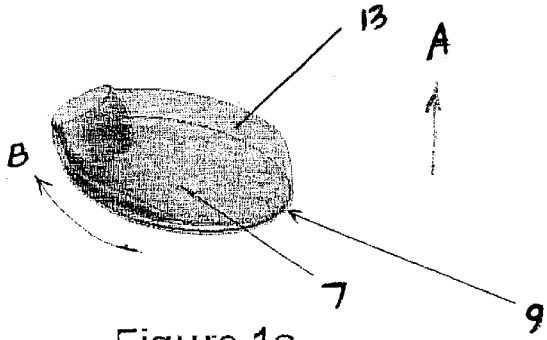

FIG. 1*c* shows a partial cutaway perspective view of the food-containing portion of the spoon with the flange.

Figure 2:
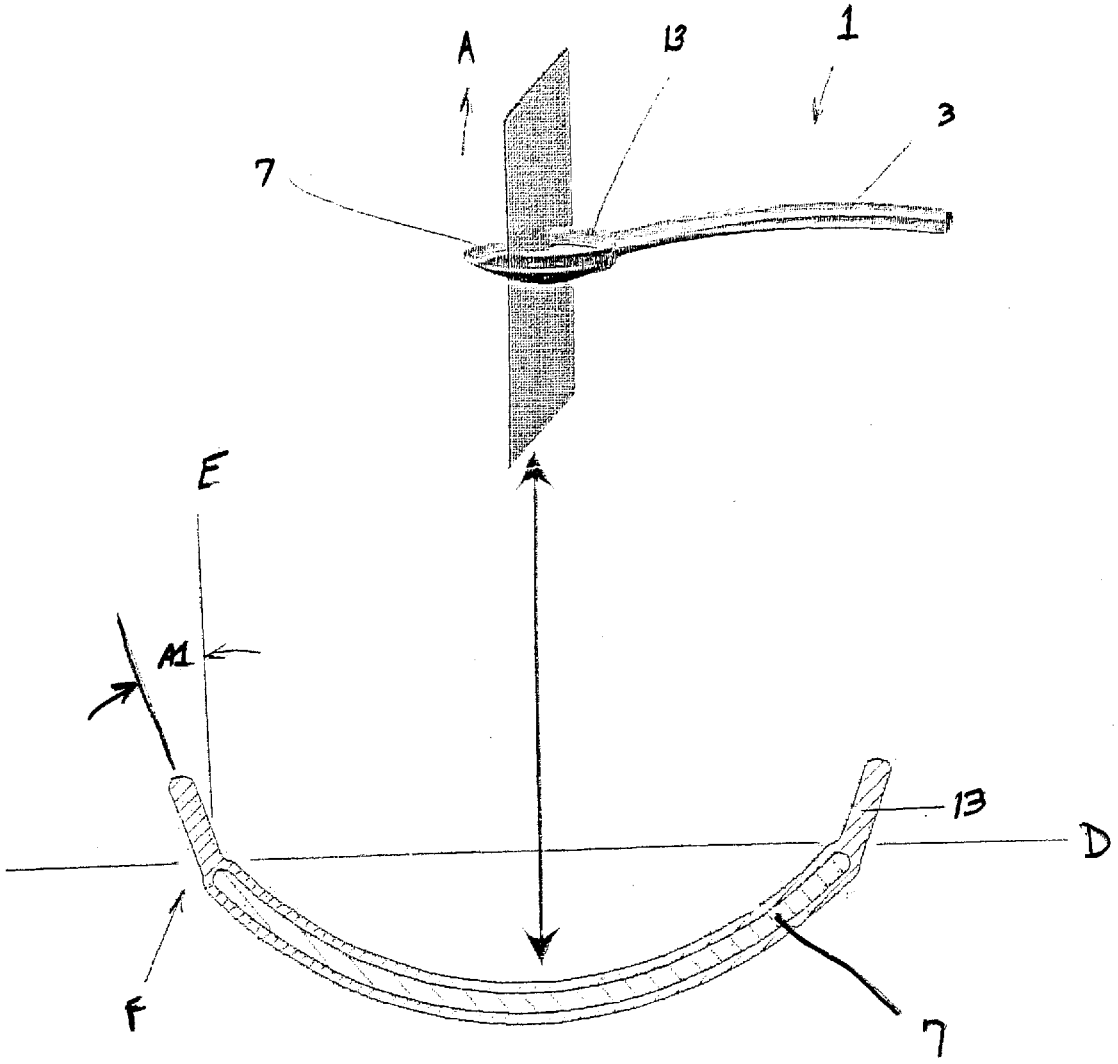

FIG. 2 shows a spoon and a cross-sectional drawing of the food-containing portion of the spoon.

IV. DESCRIPTION OF THE PREFERRED EMBODIMENT

Referring now to the drawings wherein the showings are for purposes of illustrating a preferred embodiment of the invention only and not for purposes of limiting the same, FIG. 1*a* shows a spoon depicted generally at 1. The spoon I may include a handle or handle portion 3. The handle portion 3 is generally longitudinal having first and second ends 4, 5 respectively. As is well known in the art, the handle portion 3 is grasped by the person using the utensil. Any configuration of a handle or handle portion 3 may be chosen with sound engineering judgment that is appropriate for grasping by the person using the utensil. The spoon 1 also includes a trough member or food-containing portion 7. The food-containing portion 7 may be oval in shape as depicted in FIGS. 1*a*, 1*b* and 1*c*. However, any configuration or shape of food-containing portion 7 may be chosen with sound judgment, including but not limited to round food-containing portions. The food-containing portion 7 may have a peripheral edge or periphery ridge 9 as shown in FIGS. 1*b* and 1*c*. This edge or ridge 9 defines the top of the food-containing portion 7. The food-containing portion 7 may have a concave shape 10 or a cavity 10 as shown in the FIGURES. In this manner, food carried by the utensil is generally held in the cavity 10 of the food-containing portion 7. Any depth or configuration of cavity 10 may be chosen with sound engineering judgment.

With continued reference to FIG. 1*a* and now to FIGS. 1*b* and 1*c*, the food-containing portion 7 of the spoon 1 may include a wall 13 or a flange 13. The flange 13 extends from the peripheral edge 9 of the food-containing portion in a direction A, shown in FIG. 1*c*. The flange 13 may also be formed about around the peripheral edge 9 in the direction B as shown in FIG. 1*c*. In the preferred embodiment, the flange 13 extends substantially 270 degrees about the peripheral edge 9. However, it is expressly stated that any degree of wrap of the flange 13 around the peripheral edge 9 may be chosen with sound engineering judgment, including all of the way around the peripheral edge 9 of the food-containing portion 7. In this manner, the flange 13 assists in containing the associated food in the food-containing portion 7 when the spoon 1 is tilted from the horizontal.

With continued reference to FIGS. 1*a*, 1*b* and 1*c*, the handle portion 3 and the food-containing portion 7 may be constructed from semi-rigid or rigid material capable of supporting the spoon 1 and associated food carried in the spoon 1. In the preferred embodiment, the handle portion 3 and the food-containing portion 7 may be constructed from stainless steel. However, any material chosen with sound engineering judgment may be used to construct the handle portion 3 and the food-containing portion 7 as is appropriate for supporting the spoon 1. This may include semi-rigid or rigid plastics and the like. The flange 13 may be constructed from a flexible material as will be discussed in a subsequent paragraph.

With reference to all of the FIGURES and especially FIG. 2, the flange 13 may be flexible with respect to the rigid handle and food containing portions. That is to say, that the flange may collapse when the spoon is placed in the mouth during use where the mouth closes down around the flange 13. This releases the food contained by the flange 13 and food-containing portion 7. Any flexible material may be chosen with sound engineering judgment as is appropriate for forming a flexible flange 13. In the preferred embodiment, the flange 13 is a thermoplastic. The thermoplastic may be overmolded onto the spoon 1 and depicted in FIG. 2. In that the overmolding of thermoplastic is well known in the art, no further explanation will be offered at this point. It is noted that any method of extending the flange 13 from the food-containing portion may be chosen with sound engineering judgment. It is also noted that the spoon 1 may be dishwasher safe and reusable.

With continued reference to FIGS. 1*b* and 2, a plane D is coincident with the peripheral edge 9. For ease of understanding, the plane D may be a horizontal plane. A second plane E is defined as perpendicular to plane D and tangent to the peripheral edge 9 at a point F, as shown in FIG. 2. The flange 13 may form an angle A1 with plane E at a tangent F anywhere along the peripheral edge 9. The angle may range from 5 to 15 degrees. However, it is also contemplated in an alternate embodiment that the angle may range from 0 to 45 degrees.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention, it is now claimed:

1. A spoon for use in placing food into an associated mouth, comprising:

a handle portion;

a food-containing portion having a peripheral edge;

a flange portion extended upwardly from the peripheral edge, wherein associated food contained in the food-containing portion does not spill out when the spoon is maneuvered substantially away from the horizontal position; and wherein the flange portion collapses when an associated mouth is closed over the spoon.

2. The spoon of claim 1, wherein the flange portion is constructed from silicon.

3. The spoon of claim 1, wherein the food-containing portion is constructed from a rigid metal, and, wherein the flange portion is constructed from a thermoplastic, wherein the thermoplastic is overmolded onto the spoon.

4. The spoon of claim 2, wherein a first horizontal plane is defined by the peripheral edge, and, wherein a second vertical plane is tangent to the peripheral edge food-containing portion, and, wherein the flange portion forms an angle with the vertical plane at the tangent, the angle ranging between substantially 5 degrees and 15 degrees.

* * * * *